United States Patent [19]

Hartung et al.

[11] 4,257,176

[45] Mar. 24, 1981

[54] INSOLE WITH MATERIAL RELEASED UNDER FOOT LOADS

[75] Inventors: Donald E. Hartung, Arlington Heights; Arnold L. Siegel, Bellwood, both of Ill.

[73] Assignee: Scholl, Inc., Chicago, Ill.

[21] Appl. No.: 19,086

[22] Filed: Mar. 9, 1979

[51] Int. Cl.[3] ..... A43B 13/38

[52] U.S. Cl. ..... 36/44; 36/3 B; 428/306; 428/307; 428/905

[58] Field of Search ..... 36/44, 43, 3 B, 3 R; 428/905, 306, 307

[56] References Cited

U.S. PATENT DOCUMENTS

| | | | |
|---|---|---|---|
| 945,698 | 1/1910 | Conway | 36/44 X |
| 2,061,911 | 11/1936 | Leindorf . | |
| 2,451,929 | 10/1948 | Dorgin . | |
| 2,629,678 | 2/1953 | Thompson et al. | 36/44 X |
| 3,172,817 | 3/1965 | Leupold et al. | 36/44 X |
| 3,417,494 | 12/1968 | Claff | 36/44 |
| 3,418,731 | 12/1968 | Anciaux . | |
| 3,640,629 | 2/1972 | Geiser | 428/905 X |
| 3,842,519 | 10/1974 | Lapidus . | |
| 3,852,897 | 12/1974 | Bridge et al. . | |
| 4,062,131 | 12/1977 | Hsiung . | |
| 4,145,184 | 3/1979 | Brain et al. | 428/905 X |

FOREIGN PATENT DOCUMENTS

| | | | |
|---|---|---|---|
| 2631813 | 1/1978 | Fed. Rep. of Germany | 36/44 |
| 1262036 | 4/1961 | France | 36/44 |
| 563129 | 6/1975 | Switzerland | 36/44 |
| 728075 | 3/1965 | United Kingdom | 36/44 |
| 1270809 | 4/1972 | United Kingdom . | |

*Primary Examiner*—James Kee Chi

*Attorney, Agent, or Firm*—Hill, Van Santen, Steadman, Chiara & Simpson

[57] ABSTRACT

An insole for footwear has odor masking or malodor counteractant material dissolved, trapped or encapsulated in a somewhat resilient resin coating through which it will progressively migrate or bleed under application of foot loads, foot perspiration and elevated foot temperatures to the surface of the coating to be released into the footwear to mask or counteract foot odors. The material may take the form of volatile fragrances or perfumes or materials which interact with bacteria causing foot odors, such as chlorophyll, esters and salts of certain fatty acids. Release or bleeding of the material is relatively dormant until activated by foot loads, foot perspiration or elevated temperatures. Initial foot loads, foot perspiration and elevated temperatures release the material closest to the surface of the coating in which the material is trapped and then migration proceeds slowly and progressively under repeated foot loads to provide a prolonged release time. The material which does not migrate to the surface under initial foot loads remains trapped and available for migration and release under subsequent foot loads.

14 Claims, 6 Drawing Figures

FIG. 1
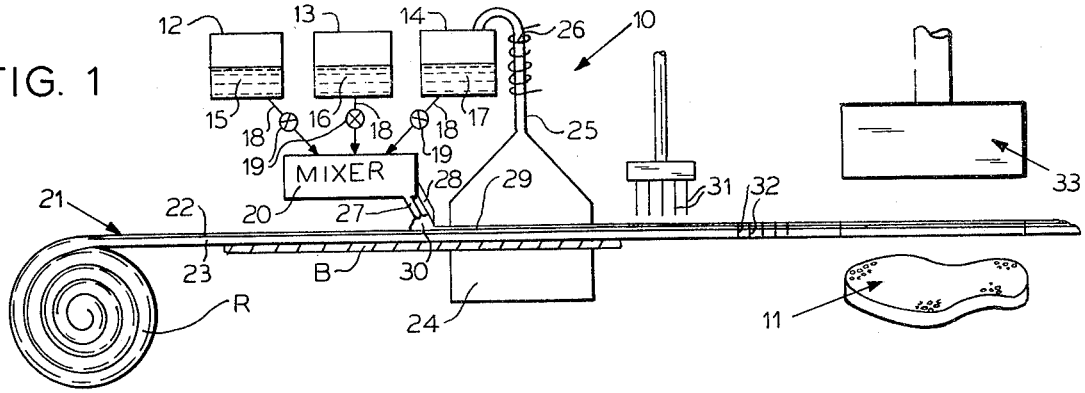
FIG. 2
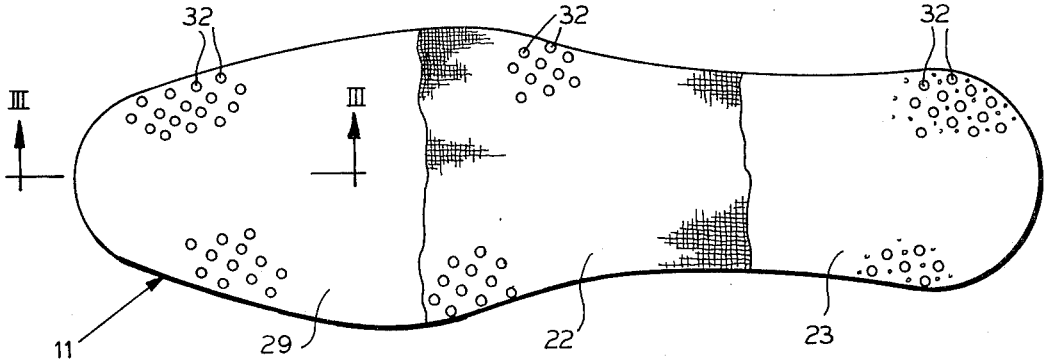
FIG. 3
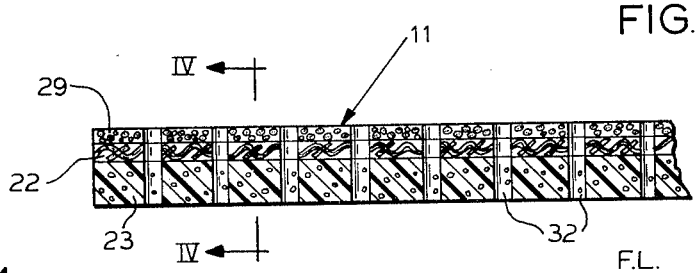
FIG. 4
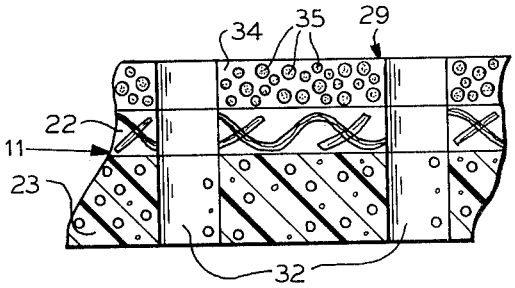
FIG. 5
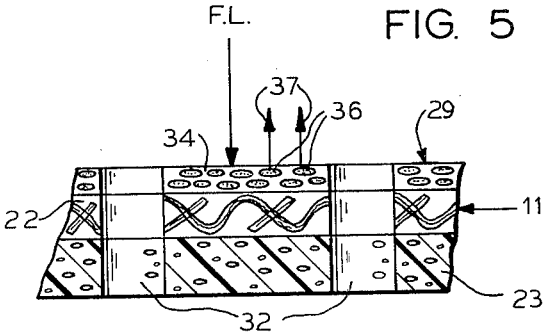
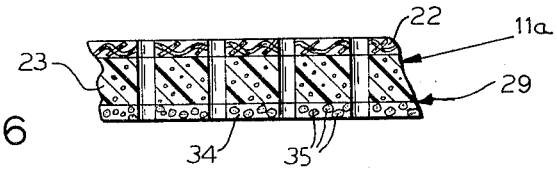
FIG. 6

INSOLE WITH MATERIAL RELEASED UNDER FOOT LOADS

FIELD OF THE INVENTION

This invention relates to the art of masking or counteracting odors in footwear and particularly deals with insoles for footwear having a resin coating in which is trapped or encapsulated, volatile odor masking or counteracting materials which will migrate to the surface of the coating under foot loads and elevated temperatures to be released progressively as the insole is used.

Prior Art

Insoles for footwear, as exemplified by the following patents, have been provided with foot treating and drying materials:

| Inventor | U.S. Pat. No. | Issue Date |
|---|---|---|
| Leindorf | 2,061,911 | Nov. 24, 1936 |
| Dorgin | 2,451,929 | Oct. 19, 1948 |
| Anciaux | 3,418,731 | Dec. 31, 1968 |
| Lapidus | 3,842,519 | Oct. 22, 1974 |
| Bridge et al | 3,852,897 | Dec. 10, 1974 |
| Hsiung | 4,062,131 | Dec. 13, 1977 |

The Scholl Manufacturing Company Limited British Pat. No. 728,075 published Apr. 13, 1955 The Associated Paper Mills Limited British Pat. No. 1,270,809 published Apr. 19, 1972

The insoles disclosed in these patents, however, contain solid materials such as activated carbon, silica gel, chlorophyll, boric acid and the like or other nonvolatile materials such as glycerine which are exposed to the atmosphere and can be used up, polluted, or lost during periods of nonuse of the insole.

It would be an improvement in the art to provide an insole with relatively volatile materials which are trapped or encapsulated until released by foot loads and temperatures during periods of use and remain dormant or trapped during periods of nonuse thereby progressively supplying the foot and surrounding atmosphere with the influence of these materials at relatively slow progressive rates to maintaining a long wear life for the insole.

SUMMARY OF THE INVENTION

According to this invention insoles for footwear and the like are provided with a resin coating, preferably on the top or bottom faces thereof, with a myriad of encapsulated droplets, beads or pockets filled with relatively volatile materials which can migrate to the surface of the coating under foot loads or elevated foot temperatures to release odor masking fragrances, odor counteractants, bacteria treating medicaments and the like into the footwear containing the insole. The encapsulated droplets may be liquid micro-encapsulations to provide slow progressive release during use. The coating is preferably somewhat resilient having a resin body composed of a low molecular weight resin material from the class of vinyl copolymers such as ethylene-vinyl acetate, ethylene-ethyl acrylate, ethylene-vinyl alcohol, ethylene-acrylic acid, and polyamide resins. The materials trapped in the resin coating include all types of perfume or fragrance oils which will mask foot odors, deodorizing agents such as chlorophyll, metallic salts of ricinoleac acid, fatty alcohol esters of methacrylic acid, and the like. Polar solvents for the resin and the odor masking and counteractive materials are used to provide a solution of the resin and materials which can be coated onto the insole and dried or cured at low temperatures which will not drive off the materials to be trapped in the resin layer.

Suitable polar solvents are alkyl alcohols such as ethanol, methanol, propanol, isopropanol, and chlorinated hydrocarbons such as methylene chloride and trichloromethane.

Preferred compositions for the resin layer incude from 0.1% to 50% by weight of the masking or odor counteracting material with a preferred range of from 2 to 10% by weight, resin in the amount of 2 to 25% by weight with a preferred range of 5 to 10% and a solvent range varying from 40 to 95% with a preferred range of 75 to 90% by weight.

The resin solution is applied to a desired depth of from 1/64 to 1/16" in thickness on either the top or bottom surface of a sheet to form the insoles. This sheet may be composed of a top layer of fabric such as cotton twill and a thicker bottom layer of foam latex. The coating is dried on the sheet, the sheet is punched with a myriad of holes and the punched sheet is then cut into insoles of the desired size and shape.

It is then an object of this invention to provide insoles for footwear with a layer of resilient carrier material trapping relatively volatile odor masking or counteracting ingredients or foot treating medicaments which can migrate or bleed to the surface and be released to the atmosphere under foot loads, foot perspiration and elevated foot temperatures.

A specific object of the invention is to provide an insole for footwear with a resin layer having dissolved therein materials which can migrate therethrough under application of foot loads or elevated foot temperatures to release odor masking or counteracting vapors to the footwear containing the insole upon application of foot loads or heat from the foot.

Another object of the invention is to provide an insole with a coating of low molecular weight resin having a perfume oil dissolved therein which can migrate to the surface of the coating under application of foot loads or elevated foot temperatures to release an odor masking fragrance into the footwear containing the insole.

Another object of this invention is to provide a resilient insole which flattens under foot load and bleeds an odor masking or odor counteracting volatile material into the footwear containing the insole.

Other and further objects of this invention will become apparent to those skilled in this art from the following detailed description of the annexed sheet of drawings and examples illustrating a preferred mode of the invention.

ON THE DRAWINGS:

FIG. 1 is a diagrammatic showing of a method of making insoles of this invention;

FIG. 2 is a top plan view of an insole according to this invention with parts broken away to show underlying layers;

FIG. 3 is an enlarged fragmentary longitudinal section along the line III—III of FIG. 2;

FIG. 4 is a greatly enlarged fragmentary vertical sectional view along the line IV—IV of FIG. 3;

FIG. 5 is a view similar to FIG. 4 illustrating the application of foot loads to the insole and the release of the trapped or encapsulated materials from the top layer; and FIG. 6 is a view similar to FIG. 3 showiing a modified insole with the resin coating on the bottom face thereof according to this invention.

AS SHOWN ON THE DRAWINGS

The apparatus 10 of FIG. 1 illustrates a manner in which insoles 11 of this invention can be manufactured. As shown, the apparatus 10 includes tanks 12,13 and 14 providing sources for perfume oil 15, a liquid resin 16, and a volatile solvent 17. These tanks discharge through pipes 18 controlled by valves 19 into a mixer 20.

A laminar sheet 21 composed of a top woven fabric such as cotton twill 22 and a foam latex base 23 is unreeled from a roll R onto a flat platform or base B under the mixer 20 and extending through an evaporating tunnel 24 with a vapor outlet 25 at the top thereof discharging into the top of the solvent tank 14 and cooled by a cooling coil 26 to condense the vapors into liquid form for adding to the liquid solvent 17 in the tank.

The mixer 20 discharges a solution of perfume oil, resin, and solvent through a duct 27 behind a scraper blade 28 spaced above the twill cover 22 of the sheet 21 for a distance to control the thickness of a coating 29 on top of the twill as it enters the tunnel 24. A pool 30 builds up behind the blade 28 to supply the coating layer 29.

The tunnel 24 is maintained at the temperature which will evaporate the solvent 17 without however evaporating the perfume oil or the resin. The evaporated solvent rises through the top outlet 25, is condensed by the cooling coil 26 and returned to the tank 14 for reuse.

The coated sheet 21 with the dried coating layer 29 emerges from the tunnel 24 and is punched with a plurality of reciprocating needles 31 to form a myriad of holes 32 through the now three layer sheet. The sheet is then fed through a cutter 33 which cuts the insoles 11 from the sheet.

The insole 11 best shown in FIGS. 2 and 3 thus has a top resin coating 29, an intermediate woven fabric layer 22 such as cotton twill, and a base layer 23 of open cell foam latex, polyurethane, or the like foam cushion material with the myriad of holes 32 through all three layers. These holes may be arranged in any desired pattern such as in longitudinal or transverse rows with the holes in adjacent rows being offset.

By way of an example the coating layer 29 may have an uncompressed thickness of 1/64 to 1/16", the fabric layer 22 may have a thickness of from 1/32 to 1/16", and the foam layer 23 may be substantially thicker varying from about ⅛ to ¼". The holes 32 are preferably about 0.05" in diameter and are spaced about 0.3" apart. A relatively thin coating layer 29 is desired to minimize cracking under bending and discomfort to the foot when the layer is the top layer.

As illustrated in FIG. 4, the top coating layer 29 is composed of a solid resin body 34 in which are trapped a plurality of droplets, beads or capsules of perfume oil 35 which might be considered to be "dissolved" in the resin body 34 but remain as a myriad of discrete beads or droplets of the oil adapted to be squeezed out of the body 34 or expanded under heat from the body. The capsules can be liquid micro-encapsulations providing the myriad of beads and providing the slow progressive release of the perfume.

Thus, as illustrated in FIG. 5 when the insole 11 is flattened under foot loads F.L. the resin body 34 of the coating layer 29 is flattened as is the foam layer 22 thereby flattening and squeezing the trapped droplets or beads of the perfume oil as illustrated at 36 and causing the oil to migrate and bleed to the top surface of the layer 29 and be released into the atmosphere as illustrated by the arrows 37. The oil may volatilize at temperatures in the footwear or merely be dispersed in the air to give off its fragrance. Since temperatures within the footwear may reach 90° to 100° F. the trapped oil tends to expand also causing migration to the surface of the coating and volatilization into the atmosphere. The migration or bleeding of the perfume oil 36 is gradual and progressive with the oil closest to the top surface of the layer 29 first being released to the atmosphere and then followed by migration of the oil trapped deeper in the coating 29. The migration or bleeding is thus slow thereby providing a long useful life for the insole.

During periods of nonuse when the insole is in its free state expanded condition as shown in FIG. 4 and at room temperatures or below the perfume oil 35 remains relatively dormant and trapped in the resin body 34.

It will therefore be understood that the active ingredients trapped in the top layer 29 are progressively released during application of foot loads to the insole which flatten and compress the layers of the insole causing migration of the trapped perfume oil to emerge at the top surface where they can give off their fragrance and mask any odors in the footwear.

Instead of applying the coating layer 29 on top of the twill 22, a modified insole **11*a* illustrated in FIG. 6 can be provided by this invention by applying the coating layer 29 to the bottom of the foam layer base 22 thereby leaving the twill layer uncovered to form the top surface for the insole. The insole 11*a* can be maufactured by the procedure of FIG. 1 by presenting the laminar sheet 21 in an upside down condition with the foam layer 23 receiving the solution from the mixer outlet 27. The loading of the insole 11*a* will cause release of the trapped perfume oil in the same manner as described in connection with the insole 11**.

By way of examples, any commercially available perfume oils are useful as masking agents. Fragrances such as Pine, Herbal, Baby Powder, and Fluerette are preferred perfume oils.

Many commercially available malodor counteractants are also useful in forming the coatings for the insoles of this invention. These counteractants, like the perfume oils, should be soluble in polar solvents and useful examples are chlorophyll, fatty acid salts such as metallic salts of ricinoleac acid including specifically "Grillocin" a product of Rita Chemical Company of Crystal Lake, Illinois, fatty alcohol esters such as specifically fatty alcohol esters of methacrylic acid including a commercial product known as "Metazene" furnished by Motomco, Inc. of Clark, New Jersey.

The material for forming the body of the resin coating is preferably a low molecular weight plastics resin from the class of vinyl copolymers and polyamides. Ethylene-vinyl acetate, ethylene-ethylacrylate, ethylene-vinyl alcohol, ethylene-acrylic acid and the like vinyl copolymers are especially useful.

The plastics resin and the perfume oil or malodor counteractant are both soluble in a polar solvent such as ethanol, methanol, propanol, isopropanol, and chlorinated hydrocarbons, specifically methylene chloride and trichloromethane. The polar solvent should vaporize at temperatures below those which would cause migration of the perfume oil or the malodor counteractant through the resin. Thus the resin should dissolve in the solvent at temperatures of no more than about 115° F. and preferably around room temperatures and not above 90° F.

The polar solvent solution of the plastics material resin and the odor masking or odor counteracating materials should preferably lie within the following ranges:

| Ingredients | Broad Range (Percentages by Weight) | Preferred Range (Percentages by Weight) |
|---|---|---|
| Odor Maskant or Counteractant | 0.1% to 50% | 2% to 10% |
| Plastics Material Resin | 2% to 25% | 5% to 10% |
| Polar Solvent | 40% to 95% | 75% to 90% |

When the solvent is evaporated the remaining coating will have a resin body of from 15 to 99.6% and preferably 50 to 85% trapping the odor maskants or odor counteractants in the amount of 0.4 to 85% and preferably 15 to 50%, all percentages being by weight.

The insoles of this invention are preferably marketed in pairs in sealed imperforate envelopes to prevent loss of volatile fragrances or odor counteractants prior to use. These sealed containers will maintain a vapor pressure minimizing any bleeding of the maskant or odor counteractant from the resin coating even at relatively hot temperatures that might exist on merchandising shelves or storage compartments housing the insoles prior to sale.

From the above descriptions it will therefore be understood that this invention provides insoles for footwear which gradually disperse or bleed out volatile materials to treat the interior of the footwear for masking or counteracting odors or the like

We claim as our invention:

1. An insole for footwear comprising a multi-laminar sheet including an open cell resilient plastics material layer, a fabric layer, and a layer of resilient plastics material with relatively volatile droplets of odor treating material trapped therein by the plastics material and progressively bleeding therefrom through the plastics material for release to the atmosphere only during periods of use of the insole where it is subjected to foot loads and elevated temperatures.

2. An insole for footwear comprising sheet material having a resilient cushion and a coating of a low molecular weight resilient resin in which are trapped by the resin micro-encapsulations of a volatile liquid adapted to progressively bleed through the coating for release at a slow rate and for a prolonged time period to the atmosphere under elevated foot temperatures and repeated application of foot loads.

3. An insole for footwear adapted to be activated under foot loads and elevated foot temperatures to release odor masking and odor counteracting materials into the footwear which comprises sheet material cut to fit the inside of shoes providing a resilient cushion in the shoes, said sheet material having a resilient resin coating on a face thereof and micro-encapsulations of volatile odor masking or odor counteracting material trapped in said coating by the resin and adapted to progressively migrate therethrough to be released to the interior of the shoe at a slow rate under repeated foot loads and elevated foot temperatures for masking or destroying odors in the shoe.

4. The insole of claim 1 wherein the plastics material is a low molecular weight resin selected from the class of vinyl copolymers and polyamide resins.

5. The insole of claim 1 wherein the odor treating material is perfume oil.

6. The insole of claim 1 wherein the odor treating material is an odor counteractant.

7. The insole of claim 6 wherein the counteractant is an ester of salt of a fatty acid.

8. The insole of claim 1 wherein the surface layer is a dried layer of a solution of plastics material and odor treating material in a polar solvent.

9. The insole of claim 2 wherein the sheet material is a multi-laminar sheet including an open cell foam resin layer.

10. The insole of claim 2 wherein the low molecular weight resilient resin is a vinyl copolymer selected from the group consisting of ethylene-vinyl acetate, ethylene-ethyl acrylate, ethylene-vinyl alcohol, and ethylene-acrylic acid resins.

11. The insole of claim 2 wherein the volatile liquid is a perfume oil.

12. The insole of claim 2 wherein the volatile liquid is an odor counteractant material.

13. The insole of claim 3 wherein the sheet material is a multi-laminar sheet including a foam latex layer and a fabric layer.

14. The insole of claim 3 including a myriad of holes through the sheet material and coating.

* * * * *

UNITED STATES PATENT AND TRADEMARK OFFICE

CERTIFICATE OF CORRECTION

PATENT NO. : 4,257,176

DATED : March 24, 1981

INVENTOR(S) : Donald E. Hartung and Arnold L. Siegel

It is certified that error appears in the above—identified patent and that said Letters Patent is hereby corrected as shown below:

Column 5, line 6, cancel "counteracating" and insert --counteracting--.

Column 6, line 28, after "ester", cancel "of", and insert --or--.

Signed and Sealed this

*Eighth* Day of *December 1981*

[SEAL]

*Attest:*

GERALD J. MOSSINGHOFF

*Attesting Officer*

*Commissioner of Patents and Trademarks*